US009797658B2

(12) United States Patent
Kim et al.

(10) Patent No.: US 9,797,658 B2
(45) Date of Patent: Oct. 24, 2017

(54) SUBCOOLER AND AIR CONDITIONER INCLUDING THE SAME

(71) Applicant: LG ELECTRONICS INC., Seoul (KR)

(72) Inventors: Beomchan Kim, Seoul (KR); Byoungjin Ryu, Seoul (KR); Byeongsu Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 191 days.

(21) Appl. No.: 14/792,036

(22) Filed: Jul. 6, 2015

(65) Prior Publication Data

US 2016/0003507 A1 Jan. 7, 2016

(30) Foreign Application Priority Data

Jul. 7, 2014 (KR) ..... 10-2014-0084558

(51) Int. Cl.

| | |
|---|---|
| ***F25B 1/00*** | (2006.01) |
| ***F28D 7/16*** | (2006.01) |
| ***F28F 9/013*** | (2006.01) |
| ***F28D 7/10*** | (2006.01) |
| *F25B 13/00* | (2006.01) |

(52) U.S. Cl.

CPC ..... *F28D 7/16* (2013.01); *F28D 7/10* (2013.01); *F28F 9/013* (2013.01); *F25B 13/00* (2013.01); *F25B 2400/13* (2013.01); *F28F 2265/30* (2013.01)

(58) Field of Classification Search

CPC .. F28D 7/16; F28D 7/10; F28D 7/0008; F28F 9/013; F28F 2265/30; F28F 1/32; F25B 2400/13; F25B 39/00; F25B 40/02; F25B 13/00

USPC ..... 165/162

See application file for complete search history.

(56) References Cited

U.S. PATENT DOCUMENTS

| | | | | |
|---|---|---|---|---|
| 4,456,058 A | | 6/1984 | Powell | |
| 5,238,057 A | * | 8/1993 | Schelter | F28F 1/325 165/158 |
| 7,104,084 B2 | * | 9/2006 | Park | F25B 40/02 62/324.1 |

(Continued)

FOREIGN PATENT DOCUMENTS

| | | |
|---|---|---|
| EP | 2568247 A2 | 3/2013 |
| KR | 100839078 B1 | 6/2008 |

(Continued)

*Primary Examiner* — Len Tran
*Assistant Examiner* — Ana Vazquez
(74) *Attorney, Agent, or Firm* — Dentons US LLP

(57) ABSTRACT

Provided are a supercooler and an air conditioner including the same. The supercooler disposed between a condenser and an evaporator of an air conditioner to supercool a refrigerant condensed in the condenser, thereby allowing the supercooled refrigerant to flow into the evaporator includes an inner tube in which a first refrigerant passing through the condenser flows, an outer tube having an inner space in which the inner tube is disposed, the outer tube allowing a second refrigerant heat-exchanged with the first refrigerant to flow by using the inner tube as a boundary, and a baffle supporting the inner tube to prevent the inner tube from being shaken within the outer tube.

16 Claims, 11 Drawing Sheets

(56) References Cited

U.S. PATENT DOCUMENTS

| | | | | |
|---|---|---|---|---|
| 2005/0279487 | A1* | 12/2005 | Wanni ..... | F28F 9/0132<br>165/162 |
| 2012/0222845 | A1 | 9/2012 | Kinder et al. | |
| 2013/0153183 | A1 | 6/2013 | Velan | |

FOREIGN PATENT DOCUMENTS

| | | | |
|---|---|---|---|
| KR | 100882525 | B1 | 2/2009 |
| KR | 10-2012-0104698 | A | 9/2012 |
| KR | 1020130027290 | A | 3/2013 |

* cited by examiner

SUBCOOLER AND AIR CONDITIONER INCLUDING THE SAME

CROSS-REFERENCE TO RELATED APPLICATIONS

The present application claims priority under 35 U.S.C. 119 and 35 U.S.C. 365 to Korean Patent Application No. 10-2014-0084558 (filed on Jul. 7, 2014), which is hereby incorporated by reference in its entirety.

BACKGROUND

The present disclosure relates to a supercooler and an air conditioner including the same.

In general, air conditioners represent apparatuses for adjusting an indoor temperature to promote pleasant indoor environments.

Such an air conditioner includes an indoor unit installed in an indoor space and an outdoor unit supplying a refrigerant into the indoor unit. Also, at least one indoor unit may be connected to the outdoor unit.

The air conditioner may receive the refrigerant into the indoor unit to perform a cooling or heating operation. Here, the cooling or heating operation of the air conditioner may be determined according to a flow of the circulating refrigerant. That is, the air conditioner may perform the cooling operation and the heating operation according to the flow of the refrigerant.

First, a flow of the refrigerant when the air conditioner performs the cooling operation will be described. The refrigerant compressed in a compressor of the outdoor unit is changed into a middle-temperature high-pressure liquid refrigerant by passing through a heat exchanger of the outdoor unit. When the liquid refrigerant is supplied into the indoor unit, the refrigerant is expanded in a heat exchanger of the indoor unit and thus is evaporated. A temperature of surrounding air of the heat exchanger of the indoor unit may descend due to the evaporation of the refrigerant. Also, when a fan of the indoor unit rotates, the surrounding air having the descending temperature of the heat exchanger of the indoor unit is discharged into an indoor space.

A flow of the refrigerant when the air conditioner performs the heating operation will be described. When a high-temperature high-pressure gas refrigerant is supplied from the compressor of the outdoor unit to the indoor unit, the high-temperature high-pressure gas refrigerant may be liquefied in the heat exchanger of the indoor unit. Energy emitted due to the liquefaction of the refrigerant may allow the surround air of the heat exchanger of the indoor unit to increase in temperature. Also, when the fan of the indoor unit rotates, the surround air having the ascending temperature of the heat exchanger of the indoor unit may be discharged into the indoor space.

A supercooler for supercooling the refrigerant condensed in a condenser before the refrigerant is expanded may be provided in the air conditioner. The supercooler may include an inner tube through which a main refrigerant circulating into a refrigeration cycle flows and an outer tube through which a branch refrigerant heat-exchanged with the main refrigerant flows. The inner tube may be disposed in a space inside the outer tube.

The branch refrigerant may be a refrigerant in which at least a portion of the main refrigerant is branched. After the branch refrigerant is expanded, the branch refrigerant may be heat-exchanged with the main refrigerant. In the heat-exchange process, the main refrigerant may be supercooled.

In the supercooler according to the related art, the inner tube may contact the outer tube to generate impact noises while the main refrigerant and the branch refrigerant flow. In addition, the inner tube may be shaken to generate refrigerant flow noises.

SUMMARY

Embodiments provide a supercooler that is improved in durability and does not generate noises due to a flow of a refrigerant and an air conditioner including the same.

In one embodiment, a supercooler disposed between a condenser and an evaporator of an air conditioner to supercool a refrigerant condensed in the condenser, thereby allowing the supercooled refrigerant to flow into the evaporator includes: an inner tube in which a first refrigerant passing through the condenser flows; an outer tube having an inner space in which the inner tube is disposed, the outer tube allowing a second refrigerant heat-exchanged with the first refrigerant to flow by using the inner tube as a boundary; and a baffle supporting the inner tube to prevent the inner tube from being shaken within the outer tube.

The inner tube may be provided in plurality, and the plurality of inner tubes may be disposed to be spaced apart from each other.

The baffle may include: a fixing member supporting an outer circumferential surface of each of the plurality of inner tubes; and a deceleration member connected to the fixing member to change a flow rate of the second refrigerant.

A flow hole in which the second refrigerant flows may be defined in the fixing member.

The fixing member may include: an inner circumferential surface defining the flow hole to surround at least a portion of outer circumferential surfaces of the plurality of inner tubes; and an outer circumferential surface supported by an inner circumferential surface of the outer tube.

The inner circumferential surface of the fixing member may include: a plurality seat surfaces on which portions of outer surfaces of each of the plurality of inner tubes are respectivley seated; and a fixing surface on which the deceleration member is disposed.

Each of the seat surfaces of the fixing member may have a curved shape to surface-contact the outer circumferential surface of each of the plurality of inner tubes.

The deceleration member may be disposed between the plurality of inner tubes and on the inner circumferential surface of the fixing member.

The deceleration member may have one surface disposed on the fixing surface of the fixing member and the other surface that is curved outward from a center of the outer tube.

The supercooler may further include a plurality of fixing protrusions protruding from the outer circumferential surface of the fixing member and fixed to the inner circumferential surface of the outer tube.

The supercooler may further include: a branch part coupled to one side of the outer tube to communicate with each of the inner tubes, the branch part branching the first refrigerant into each of the inner tubes; and a combination part coupled to the other side of the outer tube to communicate with each of the inner tube, the combination part combining the first refrigerants passing through the inner tubes with each other.

The outer tube may include: a first hole defined in an outer circumferential surface of one side of the outer tube to introduce the second refrigerant; and a second hole defined in an outer circumferential surface of the other side of the outer tube to discharge the second refrigerant heat-exchanged with the first refrigerant.

The fixing member may be provided in number corresponding to that of inner tubes, and the deceleration member may be configured to connect two fixing members to each other.

The deceleration member may be curved with a preset curvature radius with respect to a center of the outer tube, and the deceleration member may extend from one point of an outer circumferential surface of one inner tube toward one point of an outer circumferential surface of the other inner tube.

The supercooler may further include: a first flow space part defined in the baffle to allow the second refrigerant to flow; and a second flow space part defined between an outer circumferential surface of the baffle and an inner circumferential surface of the outer tube to allow the second refrigerant to flow.

In another embodiment, an air conditioner includes: a compressor compressing a refrigerant; a condenser condensing the refrigerant passing through the compressor; and a supercooler supercooling the refrigerant condensed in the condenser, wherein the supercooler includes: an inner tube in which a first refrigerant passing through the condenser flows; an outer tube having an inner space in which the inner tube is disposed, the outer tube allowing a second refrigerant heat-exchanged with the first refrigerant to flow by using the inner tube as a boundary; and a baffle including a fixing member fixed to each of the inner tubes to prevent each of the inner tubes from being shaken and a deceleration member connected to the fixing member to reduce a flow rate of the second refrigerant.

The fixing member may include: an inner circumferential surface defining a flow hole to support outer circumferential surfaces of the plurality of inner tubes; and an outer circumferential surface supported by an inner circumferential surface of the outer tube.

The inner circumferential surface may include a seat surface on which the plurality of inner tube are seated and a fixing surface on which the deceleration member is disposed, and the deceleration member may protrude from the fixing surface in a central direction of the flow hole.

The fixing member may surround at least a portion of the outer circumferential surfaces of the plurality of inner tubes, and the deceleration member may extend from one point of an outer circumferential surface of one inner tube toward one point of an outer circumferential surface of the other inner tube.

The air conditioner may further include: a first flow space part defined in the baffle to allow the second refrigerant to flow; and a second flow space part defined between an outer circumferential surface of the baffle and an inner circumferential surface of the outer tube to allow the second refrigerant to flow.

The details of one or more embodiments are set forth in the accompanying drawings and the description below. Other features will be apparent from the description and drawings, and from the claims.

DETAILED DESCRIPTION OF THE EMBODIMENTS

Figure 1:
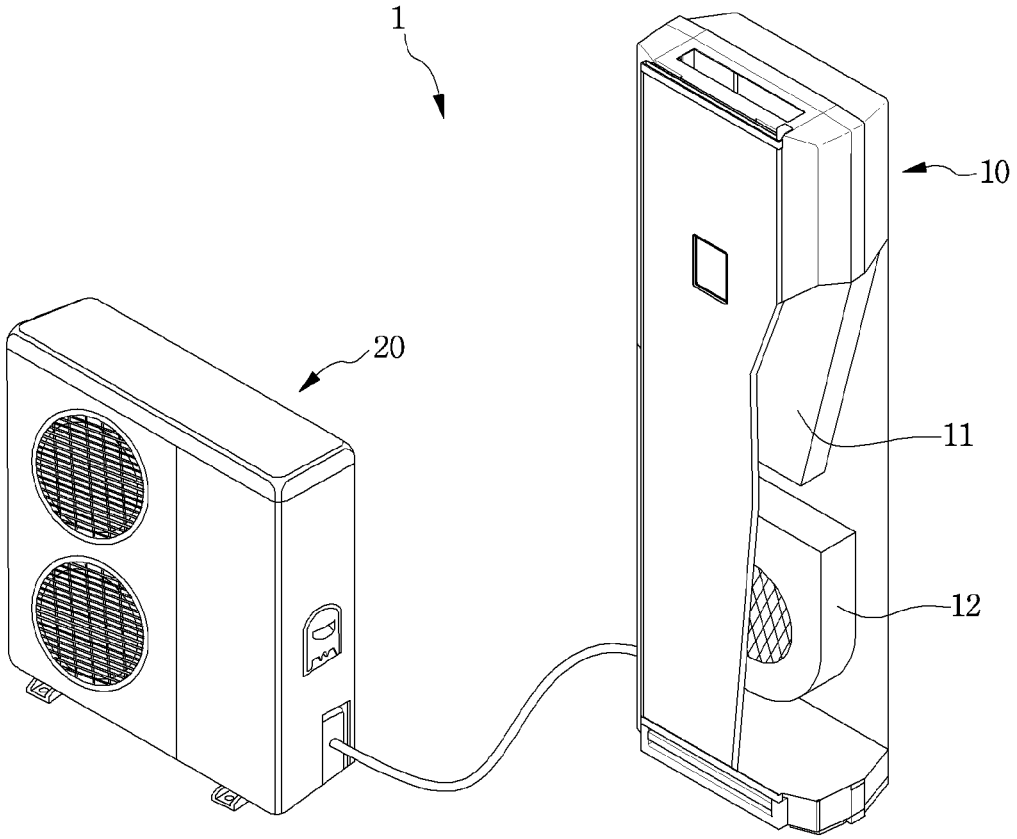
FIG. 1 is a view of an air conditioner according to an embodiment.

Preferred embodiments of the present disclosure will be described below in more detail with reference to the accompanying drawings. Note that the same or similar components in the drawings are designated by the same reference numerals as far as possible even if they are shown in different drawings. In the following description of the present disclosure, a detailed description of known functions and configurations incorporated herein will be omitted to avoid making the subject matter of the present disclosure unclear.

In the description of the elements of the present disclosure, the terms 'first', 'second', 'A', 'B', '(a)', and '(b)' may be used. However, since the terms are used only to distinguish an element from another, the essence, sequence, and order of the elements are not limited by them. When it is described that an element is "coupled to", "engaged with", or "connected to" another element, it should be understood that the element may be directly coupled or connected to the other element but still another element may be "coupled to", "engaged with", or "connected to" the other element between them.

Hereinafter, a supercooler and an air conditioner including the supercooler according to an embodiment will be described with reference to the accompanying drawings.

Hereinafter, an indoor unit and outdoor unit of the air conditioner will be described.

Figure 2:
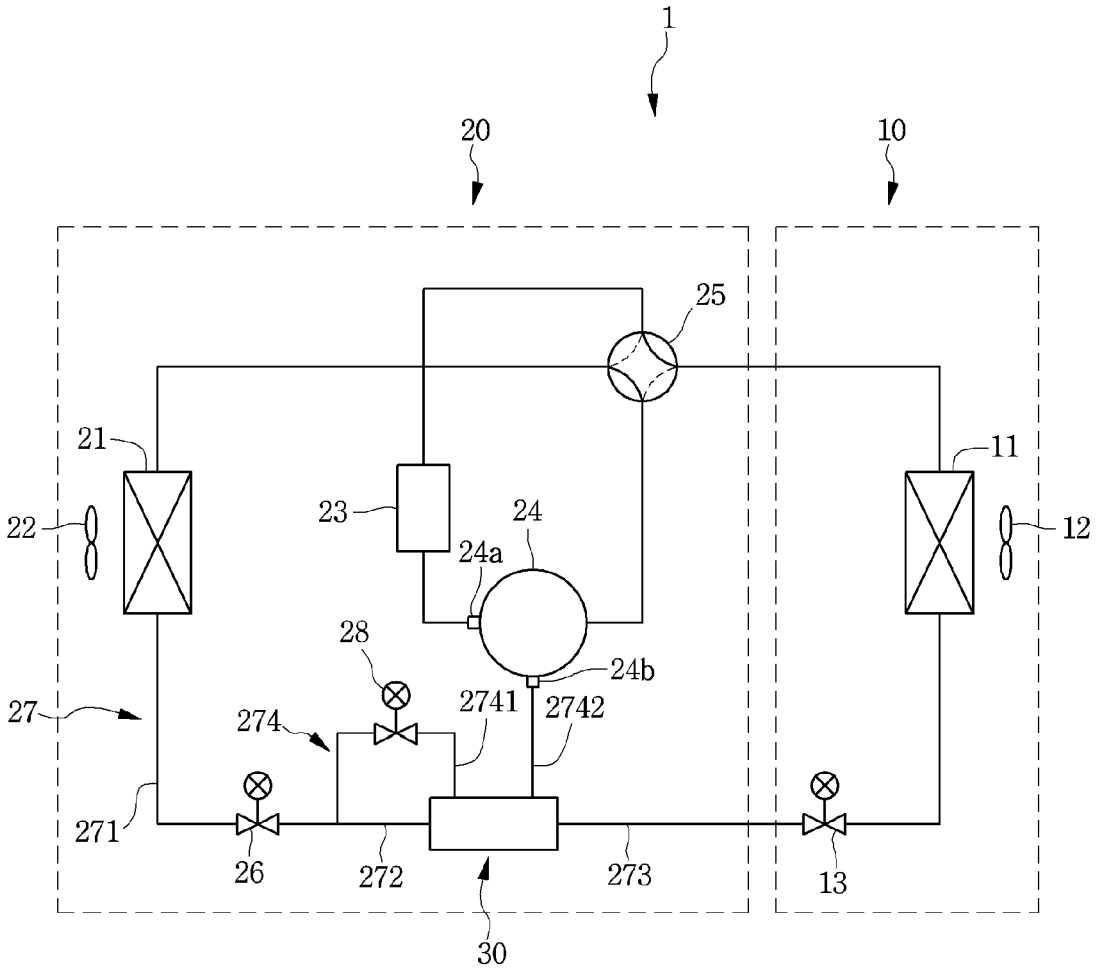
FIG. 2 is a view illustrating a system of the air conditioner of FIG. 1.

FIG. 1 is a view of an air conditioner according to an embodiment, and FIG. 2 is a view illustrating a system of the air conditioner of FIG. 1.

Referring to FIGS. 1 and 2, an air conditioner 1 according to an embodiment includes an indoor unit 10 and an outdoor unit 20. For example, the indoor unit 10 may be a stand-type indoor unit. However, the present disclosure is not limited thereto. For example, the indoor unit 10 may be a wall mount-type indoor unit or a ceiling mount-type indoor unit.

The indoor unit 10 discharges heat-exchanged air into an indoor space. Also, the indoor unit 10 is connected to the outdoor unit 20 through a refrigerant tube 27. While a refrigerant circulates through the refrigerant tube 27, a refrigeration cycle including compression, condensation, expansion, and evaporation may operate. Also, as the refrigerant circulates, the conditioned air may be discharged from the indoor unit 10 into the indoor space. Also, the indoor unit 10 may be provided in plurality, and the plurality of indoor units 10 may be connected to the outdoor unit 20.

The indoor unit 10 and the outdoor unit 20 may be connected to each other through a communicable cable to transmit or receive a control command therebetween according to a predetermined communication manner.

The indoor unit 10 has an air suction hole through which indoor air is suctioned and an air discharge hole through which air heat-exchanged in the indoor unit 10 is discharged. Also, the indoor unit 10 may include a wind direction adjustment unit provided in the air discharge hole. The wind direction adjustment unit may open or close the air discharge hole and controls a direction of the air discharged from the air discharge hole. Also, the indoor unit 10 may adjust an amount of air discharged from the air discharge hole.

Also, the indoor unit 10 may include a vane installed in the air suction hole or the air discharge hole. The vane may open or close at least one of the air suction hole and the air discharge hole to guide a flow of air.

Also, the indoor unit 10 may further include a display unit for displaying an operation state and set information of the indoor unit 10 and an input unit for inputting set data. When a user inputs an operation command of the air conditioner through the input unit, the outdoor unit 20 performs a cooling or heating operation in response to the inputted operation command.

In detail, the outdoor unit 20 includes a compressor for compressing the refrigerant and a gas-liquid separator 23 for a liquid refrigerant from the refrigerant suctioned into the compressor 24. Also, the outdoor unit 20 further includes a flow switching valve 25 for guiding the refrigerant compressed in the compressor 24 into an outdoor heat exchanger 21 or indoor heat exchanger 11.

When the air conditioner 1 performs the cooling operation, the refrigerant compressed in the compressor 24 is guided to the outdoor heat exchanger 21 via the flow switching valve 25. When the air condition 1 performs the heating operation, the compressed refrigerant is guide to the indoor heat exchanger 11 via the flow switching valve 25.

The outdoor unit 20 further includes an outdoor heat exchanger 21 that is heat-exchanged with external air and an outdoor fan 22 disposed on a side of the outdoor heat exchanger 21 to blow the external air toward the outdoor heat exchanger 21.

Also, the outdoor unit 20 further includes an outdoor expansion device 26 for decompressing the refrigerant when the air conditioner 1 performs the heating operation. For example, the outdoor expansion device 26 may include an electronic expansion valve (EEV) of which an opening degree is adjustable.

The outdoor unit 20 further includes a supercooler 30 for supercooling the condensed refrigerant. The supercooler 30 may be disposed between the outdoor heat exchanger 21 and the indoor heat exchanger 11 with respect to a flow direction of the refrigerant when the air conditioner 1 performs the cooling or heating operation.

The indoor unit 10 includes an indoor heat exchanger 11 in which the indoor air and the refrigerant are heat-exchanged with each other and an indoor blower 12 for blowing the indoor air to the indoor heat exchanger 11.

Also, the indoor unit 10 further includes an indoor expansion device 13 for decompressing the refrigerant when the air conditioner 1 performs the cooling operation. For example, the indoor expansion device 13 may include an electronic expansion valve (EEV) of which an opening degree is adjustable.

Hereinafter, constitutions of the air conditioner and a flow of the refrigerant when the air conditioner performs the cooling operation will be described.

Figure 3:
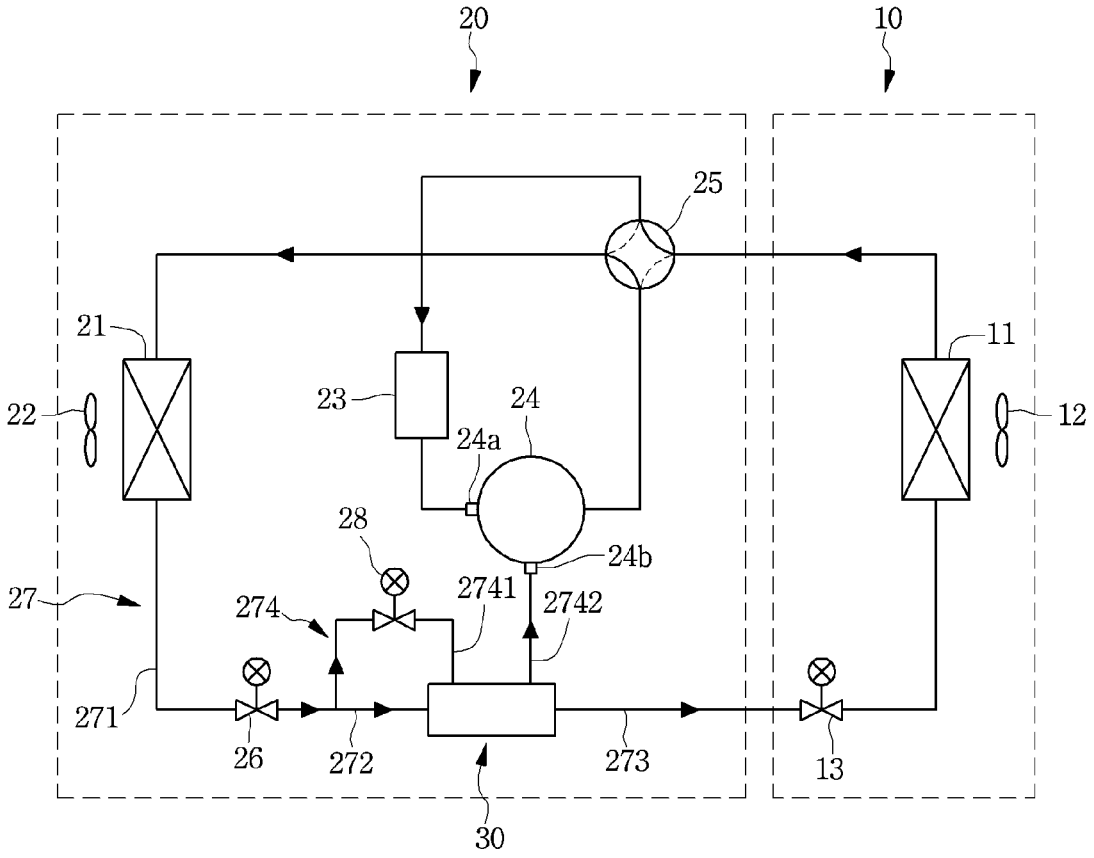
FIG. 3 is a view illustrating a flow of a refrigerant when the system of the air conditioner of FIG. 2 performs a cooling operation.

FIG. 3 is a view illustrating a flow of the refrigerant when the system of the air conditioner of FIG. 2 performs the cooling operation.

When the air conditioner 1 performs the cooling operation, the refrigerant is compressed in the compressor 24 and condensed in the outdoor heat exchanger 21. Also, the refrigerant is expanded in the indoor expansion device 13 and evaporated in the indoor heat exchanger 11. Also, the evaporated refrigerant is suctioned into a suction port 24*a* of the compressor 24 via the gas-liquid separator 23. This cycle may be repeatedly performed.

In more detail, when the air conditioner 1 performs the cooling operation, the refrigerant condensed in the outdoor heat exchanger 21 may supercooled in the supercooler 30 to flow into the indoor unit 10.

The refrigerant condensed in the outdoor heat exchanger 21 may flow into a refrigerant tube 27. The refrigerant tube 27 may include a main tube 271, a main inflow tube 272, and a main discharge tube 273. The main tube 271 may be understood as a tube that connects the components of the air conditioner 1 to each other to guide a flow of the refrigerant.

The main inflow tube 272 may be connected to the main tube 271 to communicate with the supercooler 30. The main inflow tube 272 may define an inflow passage of the supercooler 30 to introduce a main refrigerant transferred from the main tube 271 into the supercooler 30.

The main discharge tube 273 communicates with the supercooler 30 to guide the discharge of the main refrigerant that is heat-exchanged in the supercooler 30. Here, the main refrigerant may be called a "first refrigerant" as a refrigerant flowing through the main tube 271.

The refrigerant tube 27 may further include an injection tube 274 that branches a portion of the first refrigerant of the main tube 271 to inject the branched refrigerant into the compressor 24. The injection tube 274 is branched from the main tube 271 and connected to the supercooler 30. The refrigerant that is partially branched from the first refrigerant may be called a "second refrigerant".

The injection tube 274 includes an injection inflow tube 2741 for introducing the second refrigerant into the supercooler 30. The injection inflow tube 2741 communicates with the supercooler 30 at a position different from that of the main inflow tube 272.

Also, the injection tube 274 further includes an injection discharge tube 2742 for guiding discharge of the second refrigerant introduced into the supercooler 30 through the injection inflow tube 2741. The injection discharge tube 2742 communicates with the supercooler 30 at a position different from that of the main discharge tube 273. The refrigerant discharged through the injection discharge tube 2742 is injected into an injection port 24*b* of the compressor 24.

The injection tube 274 may include an injection expansion device 28 for expanding the second refrigerant. In detail, the injection expansion device 28 may be disposed in the injection inflow tube 2741. The second refrigerant is changed into a refrigerant having a temperature and pressure less than those of the first refrigerant while passing through the injection expansion device 28. Then, the second refrigerant may supercool the first refrigerant while being heat-exchanged with the first refrigerant.

The first refrigerant supercooled in the supercooler 30 is expanded while passing through the indoor expansion device 13 and evaporated in the indoor heat exchanger 11.

Hereinafter, a flow of the refrigerant when the air conditioner performs the heating operation will be described.

Figure 4:
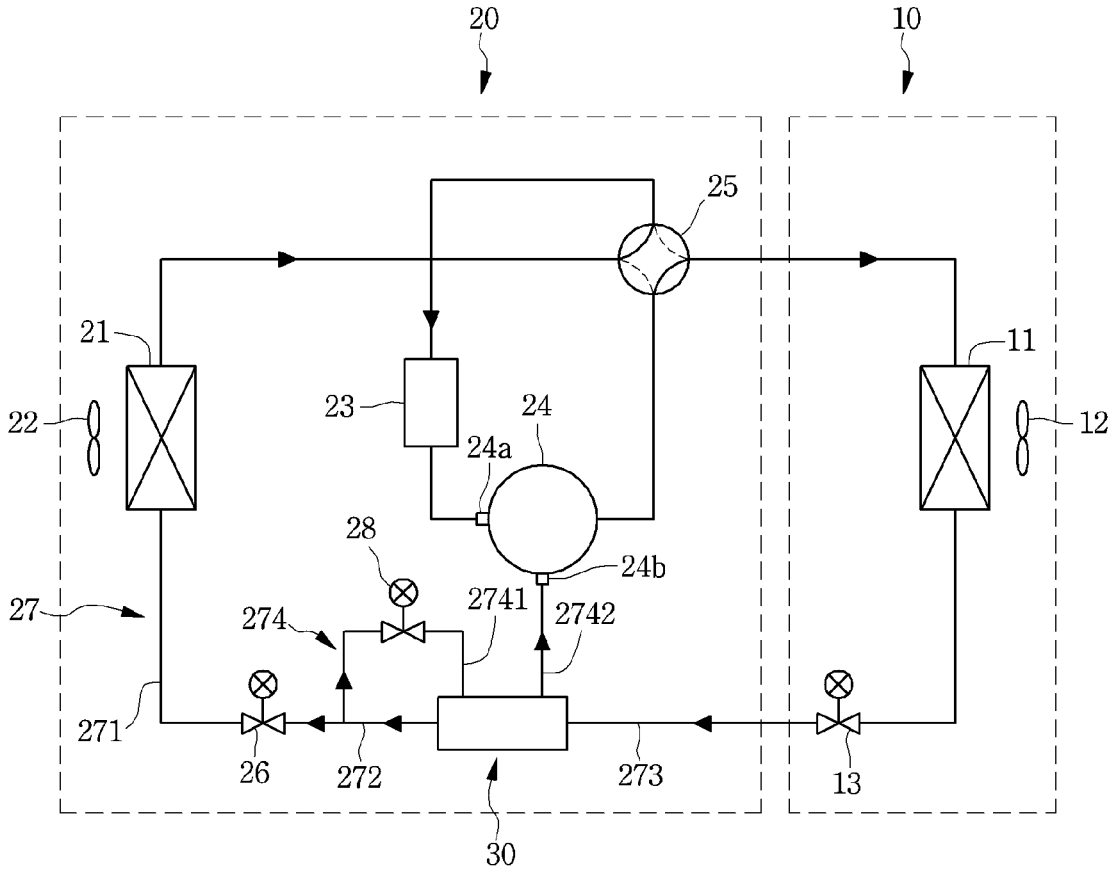
FIG. 4 is a view illustrating a flow of a refrigerant when the system of the air conditioner of FIG. 2 performs a heating operation.

FIG. 4 is a view illustrating a flow of a refrigerant when the system of the air conditioner of FIG. 2 performs the heating operation.

Referring to FIG. 4, when the air conditioner performs the heating operation, the refrigerant in the supercooler may flow in a direction opposite to that when the air conditioner performs the cooling operation.

In detail, the refrigerant compressed in the compressor 24 is introduced into the indoor heat exchanger 11. The refrigerant condensed in the indoor heat exchanger 11 is introduced into the supercooler 30 through the main discharge tube 273 and then discharged into the main inflow tube 272. Also, the discharged first refrigerant is expanded in the outdoor expansion device 26 and evaporated in the outdoor heat exchanger 21. The evaporated refrigerant is suctioned into the suction port 24*a* of the compressor 24 via the gas-liquid separator 23. This cycle may be repeatedly performed.

The second refrigerant that is a portion of the first refrigerant discharged into the main inflow tube 272 is branched into the injection inflow tube 2741. Then, the branched refrigerant is expanded in the injection expansion device 274 and introduced into the supercooler 30. The first refrigerant and the second refrigerant are heat-exchanged with each other within the supercooler 30. Here, while the first and second refrigerants are heat-exchanged with each other, the second refrigerant is evaporated and then injected into the injection port 24*b* of the compressor 24.

Hereinafter, the supercooler will be described with reference to the accompanying drawings.

Figure 5:
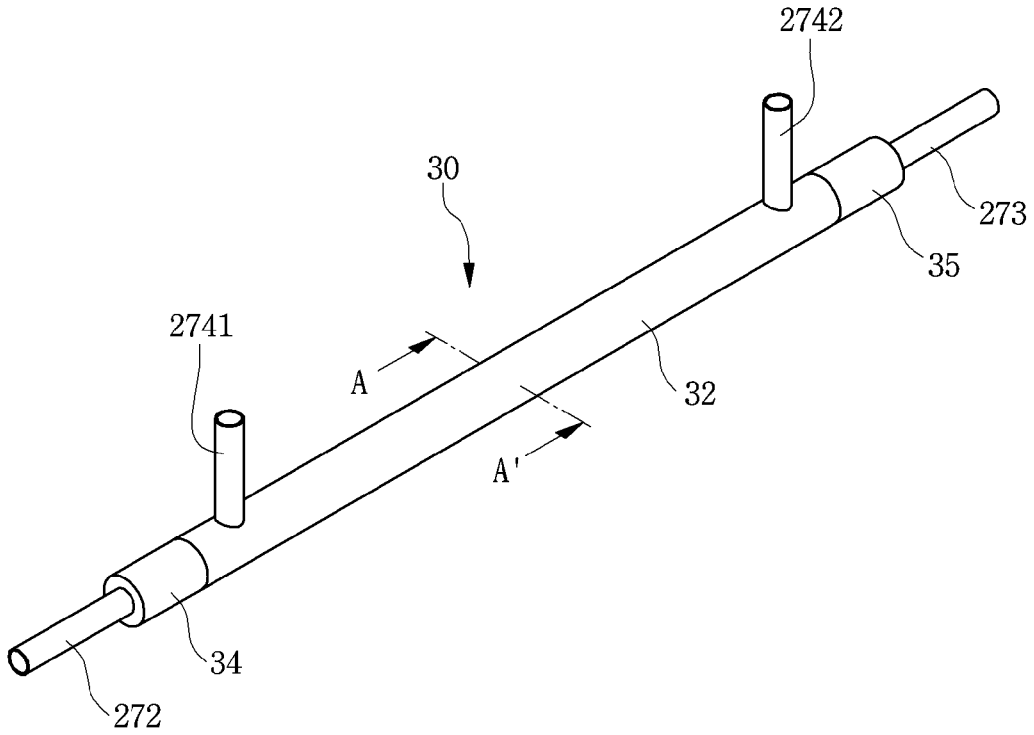
FIG. 5 is a perspective view illustrating a supercooler of the air conditioner of FIG. 2.
Figure 6:
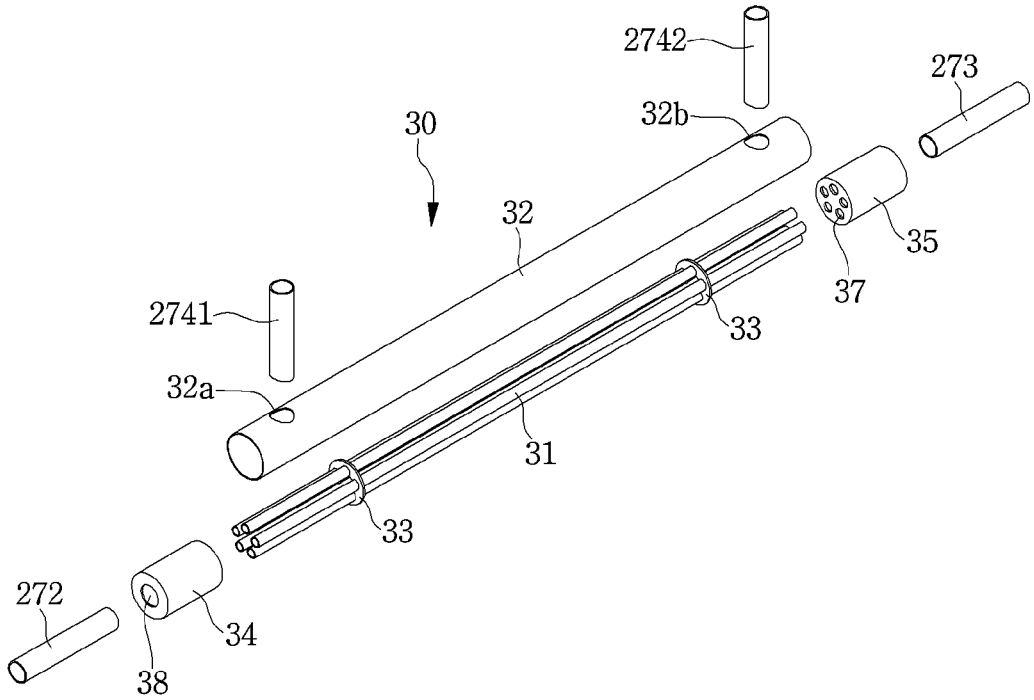
FIG. 6 is an exploded perspective view illustrating the supercooler of FIG. 5.
Figure 7:
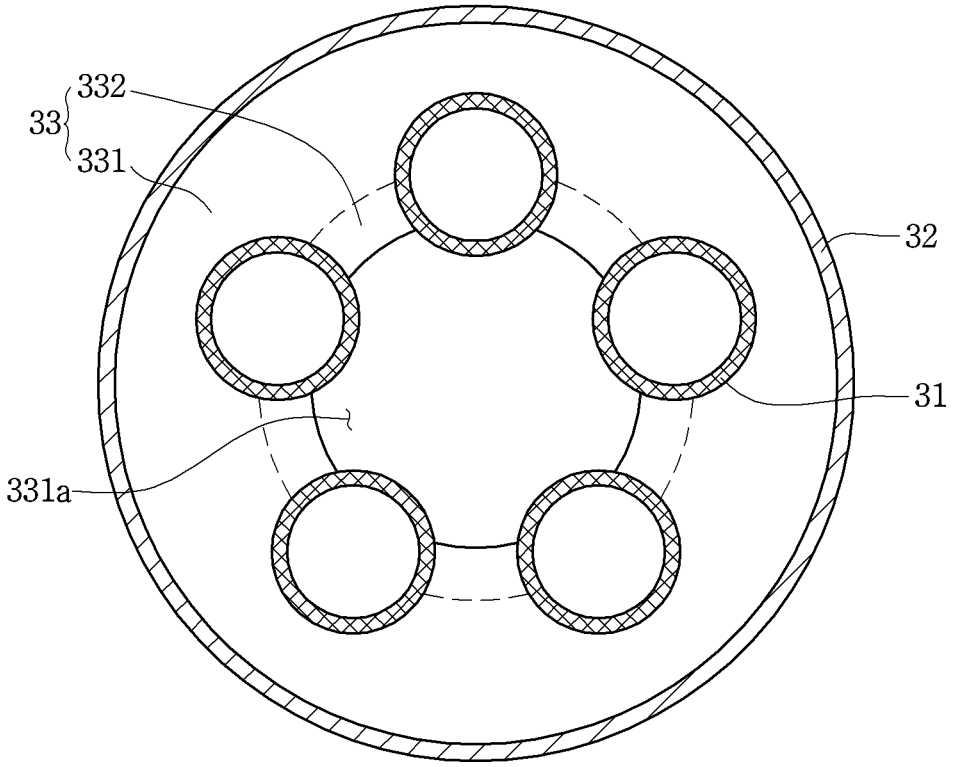
FIG. 7 is a cross-sectional view taken along line A-A' of FIG. 7.
Figure 8:
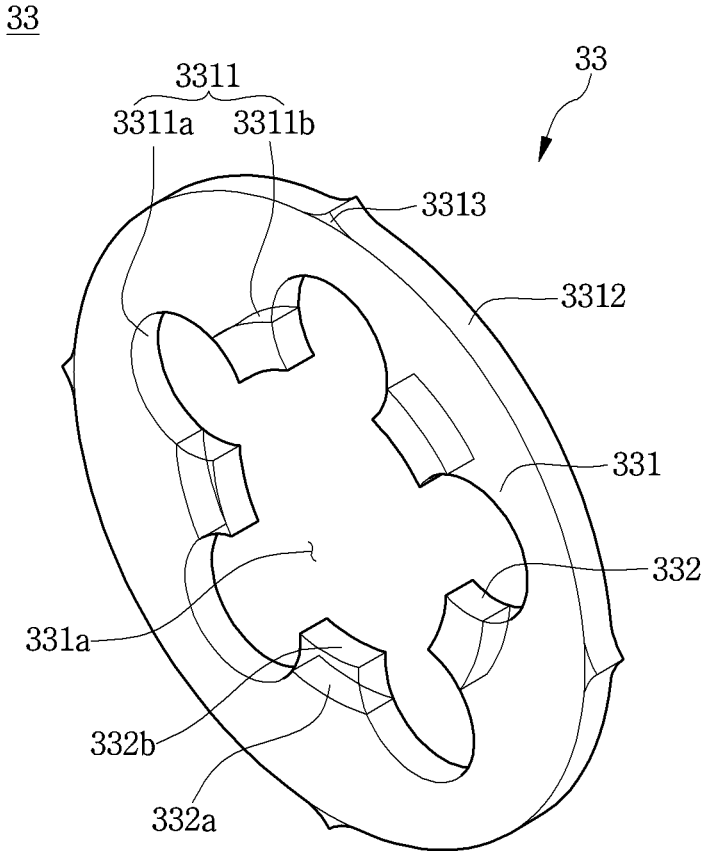
FIG. 8 is a perspective view of a baffle installed on the supercooler of FIG. 5.

FIG. 5 is a perspective view illustrating the supercooler of the air conditioner of FIG. 2, FIG. 6 is an exploded perspective view illustrating the supercooler of FIG. 5, FIG. 7 is a cross-sectional view taken along line A-A' of FIG. 7, and FIG. 8 is a perspective view of a baffle installed on the supercooler of FIG. 5.

Referring to FIGS. 5 to 8, the supercooler 30 includes a plurality of inner tubes 31, an outer tube 32, and a baffle 33.

The external tube 32 defines an outer appearance of the supercooler 30. A space in which the plurality of inner tubes 31 are disposed is defined in the outer tube 32. Also, the second refrigerant may flow through the space defined in the outer tube 32.

The plurality of inner tubes 31 are disposed in the inner space of the outer tube 32. Also, the plurality of inner tubes 31 may be disposed to be spaced apart from each other.

The outer tube 32 has a first hole 32*a* and a second hole 32*b*. The first hole 32*a* is defined in an outer circumferential surface of one side of the outer tube 32, and the second hole 32*b* is spaced apart from the first hole 32*a* and defined in an outer circumferential surface of the other side of the outer tube 32.

The injection inflow tube 274 may communicate with the outer tube 32 through the first hole 32*a*, and the injection discharge tube 2742 may communicate with the outer tube 32 through the second hole 32*b*.

Thus, the second refrigerant is introduced into the outer tube 32 through the injection inflow tube 2741, and the second refrigerant introduced into the outer tube 32 is discharged to the outside through the injection discharge tube 2742 to flow into the injection port 24*b* that is the compressor 24.

The supercooler 30 further includes a branch part 34 and a combination part 35.

Also, the branch part 34 and the combination part 35 may be respectively disposed on both ends of the outer tube 32 to prevent the second refrigerant from leaking through both sides of the outer tube 32. Each of the branch part 34 and the combination part 35 includes a tube coupling part 37 to which the plurality of inner tubes 31 are coupled.

The branch part 34 and the combination part 35 connect both ends of each of the inner tubes 31 disposed in the inner space of the outer tube 32 to the main inflow tube 272 and the main discharge tube 273, respectively. In detail, a tube coupling part 38 to which the main inflow tube 272 and the main discharge tube 273 are coupled is disposed on each of the branch part 34 and the combination part 35.

In more detail, the branch part 34 communicates with the main inflow tube 272. Thus, the branch part 34 may branch the first refrigerant introduced from the main inflow tube 272 into each of the inner tubes 31 or combine the first refrigerant discharged from each of the inner tubes 31 into the main inflow tube 272 according to a flow direction of the first refrigerant.

Also, the combination part 35 communicates with the main discharge tube 273. Thus, the combination part may combine the first refrigerant discharged from each of the inner tubes 31 to guide the combined refrigerant into the main discharge tube 273 and branch the first refrigerant introduced from the main discharge tube 273 into each of the inner tubes 31.

As described above, the first refrigerant compressed in the condenser flows in each of the inner tubes 31, and the second refrigerant having a low-temperature low-pressure, which is expanded in the injection expansion device 28 flows in the outer tube 32. Thus, the first refrigerant and the second refrigerant may be heat-exchanged with each other by using an outer circumferential surface of each of the inner tubes 31 as a boundary surface or heat-exchange surface.

The baffle 33 connects the inner tubes 31 to each other to prevent each of the inner tubes 31 from being shaken. On the other hand, the baffle 33 may be coupled to the outer circumferential surface of each of the inner tube 31.

The baffle 33 includes a fixing member 331 and a deceleration member 332.

The fixing member 331 may be fixed to each of the inner tubes 31 to prevent the inner tube 31 from being shaken. When each of the inner tubes 31 is shaken while the first and second refrigerants flow, noises may be generated due to the contact between the refrigerant and an inner surface 3311 of the outer tube 32. Here, the fixing member 331 may prevent each of the inner tubes 31 from being shaken to reduce the noises generated due to the shaking of the inner tube 31.

The fixing member 331 may have an approximately annular shape. A flow hole 331*a* in which the second refrigerant flows is defined in the fixing member 331.

The fixing member 331 includes an inner circumferential surface 3311 defining the flow hole 331*a* and supporting the outer circumferential surface of each of the inner tubes 31 and an outer surface 3312 supported by the inner circumferential surface of the outer tube 32. That is to say, the inner circumferential surface 3311 fixes each of the inner tubes 31, and the outer circumferential surface 32 is fixed to the inner circumferential surface of the outer tube 32. Also, the inner circumferential surface 3311 may be disposed to surround at least a portion of the outer circumferential surface of each of the inner tubes 31.

The fixing member 331 may further include a fixing protrusion 3313. The fixing protrusion 3313 is disposed to protrude from the outer circumferential surface of the fixing member 331. The fixing protrusion 3313 may be provided in plurality, and the plurality of fixing protrusions 3313 may be disposed to be spaced apart from each other.

To fix the fixing member 331 to the inner circumferential surface of the outer tube 32, the fixing member 331 is disposed inside the outer tube 32. When the outer tube 32 is pressed, the fixing protrusion 3313 may be inserted into the inner circumferential surface of the outer tube 32. Thus, the fixing member 331 may be firmly fixed to the inner circumferential surface of the outer tube 32.

The inner circumferential surface 3311 of fixing surface may include a plurality of seat surfaces 3311*a* on which portions of the outer surfaces of the inner tubes 31 are respectively seated and a fixing surface 3311*b* on which the deceleration member 332 is disposed.

Each of the seat surfaces 3311*a* may have a curved shape that surface-contacts the outer circumferential surface of each of the inner tubes 31. Thus, a portion of the outer circumferential surface of each of the inner tubes 31 may be seated on the seat surface 3311*a* of the fixing member 331 and then fixed to the fixing member 331.

The deceleration member 332 may be connected to the fixing member 331 to reduce a flow rate of the second refrigerant, thereby increasing heat exchange efficiency between the first and second refrigerants.

The deceleration member 332 is disposed between the inner tubes 31 and disposed on the fixing surface 3311*b* of the fixing member 331. The fixing surface 3311*b* may define at least a portion of the inner circumferential surface 3311. Also, the deceleration member 332 may protrude form the fixing surface 3311*b* of the fixing member 331 in a central direction of the flow hole 331*a*.

In more detail, the deceleration member 332 may have one surface 332*a* fixed to the fixing surface 3311*b* of the fixing member 331 and the other surface facing a center of the flow hole 331*a*. Also, the other surface 332*b* of the deceleration member 332 may have a shape that is curved outward from the center of the flow hole 331*a*.

That is, since the deceleration member 332 is disposed in the flow hole 331*a* defined in the fixing member 331 to allow the second refrigerant to flow, the second refrigerant passing through the flow hole 331*a* may be reduced in flow rate to generate a turbulent flow.

Hereinafter, a baffle according to another embodiment will be described.

Figure 9:
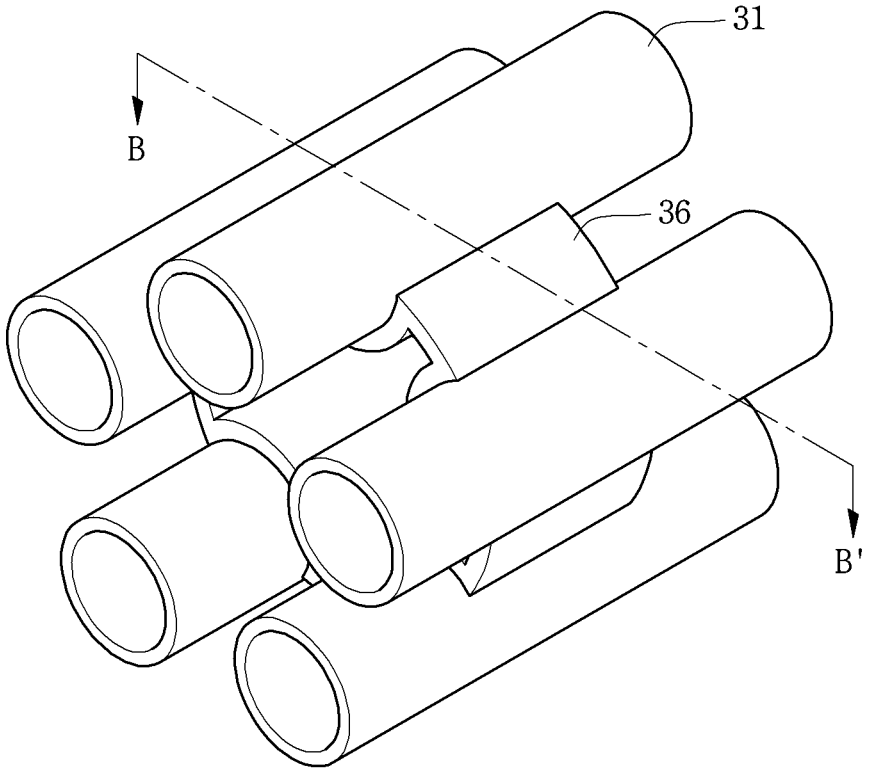
FIG. 9 is a perspective view of a baffle according to another embodiment.
Figure 10:
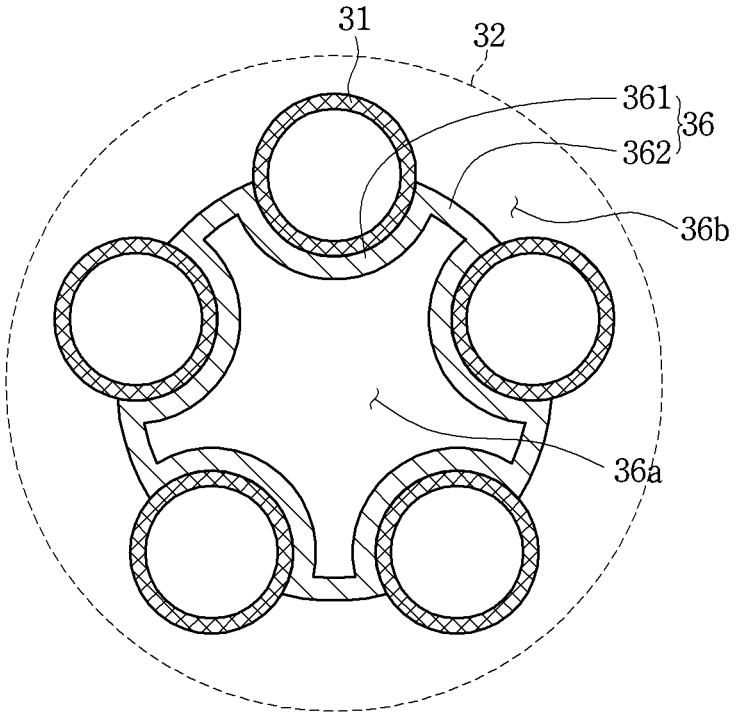
FIG. 10 is a cross-sectional view of the baffle, taken along line B-B' of FIG. 9.

FIG. 9 is a perspective view of a baffle according to another embodiment, and FIG. 10 is a cross-sectional view of the baffle, taken along line B-B' of FIG. 9.

Referring to FIGS. 9 and 10, a baffle 36 according to another embodiment may include a fixing member 361 and a deceleration member 362 extending from the fixing member 361. The fixing member 361 is provided in number corresponding to that of inner tubes 31. The deceleration member 362 is configured to connect two fixing members 361 to each other.

The fixing member 361 may have a curved plate shape so that the fixing member 361 surface-contacts an outer circumferential surface of each of the inner tubes 31 and is fixed. Also, the deceleration member 362 is disposed between the inner tubes 31 and has both ends connected to the fixing member 361.

Also, the deceleration member 362 may have a shape that is curved outward from a center of an outer tube 32. On the other hand, the deceleration member 362 may have a curved surface having a preset curvature radius with respect to the center of the outer tube 32. Also, the deceleration member 362 may extend from one point of an outer circumferential surface of one inner tube 31 to one point of an outer circumferential surface of the other inner tube 31.

A first flow space part 36*a* in which the second refrigerant flows may be defined in the baffle 36. That is, the baffle 36 may have a hollow annular shape by connecting the fixing member 361 to the deceleration member 362. Thus, the first flow space part 36*a* may be defined in the fixing member 361 and the deceleration member 362.

Also, a second flow space part 36*b* in which the second refrigerant flows may be defined outside the baffle 36. The second flow space part 36*b* may be understood as a space defined between an outer circumferential surface of the inner tube 31 or baffle 36 and an inner circumferential surface of the outer tube 32.

In summary, the second refrigerant may be divided with respect to the baffle 36 to flow into the first flow space part 36*a* that is an inner space of the baffle 36 and the second flow space part 36*b* that is a space between the outer tube 32 and the baffle 36.

Also, while the second refrigerant flows in the outer tube 32, the flow of the second refrigerant may include a flow that is branched into the second flow space part 36*b* and the first flow space part 36*a* and a flow in which the branched flows are combined again with each other. Thus, a turbulent flow may be generated in the flow of the second refrigerant to improve heat exchange efficiency between the first refrigerant and the second refrigerant.

Hereinafter, performance of the supercooler according to an embodiment will be described.

Figure 11:
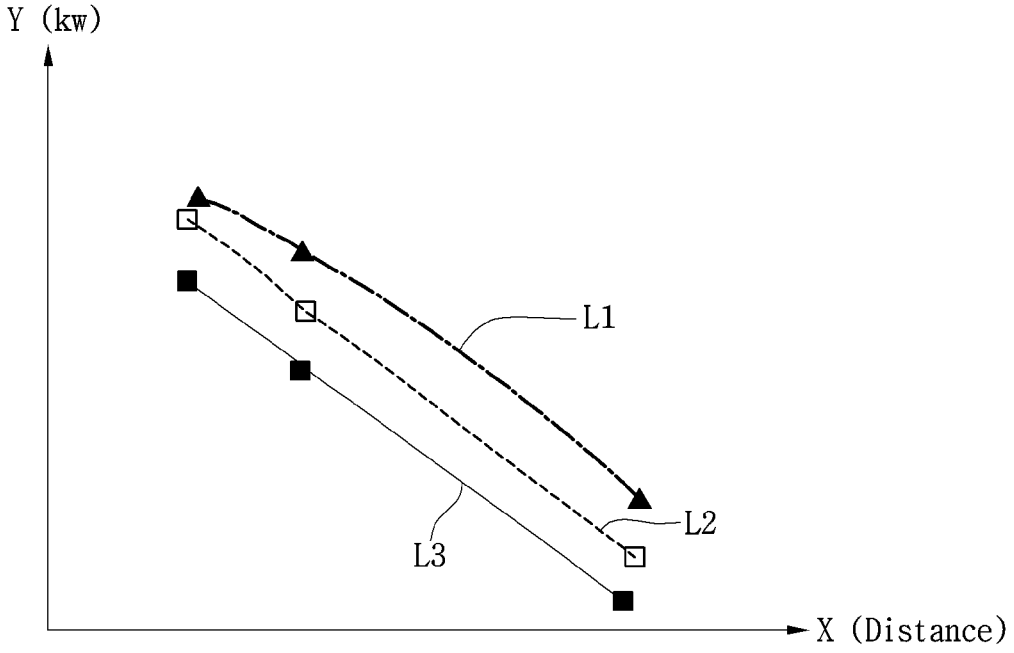
FIG. 11 is a graph illustrating heat-exchange performance of the supercooler according to an embodiment.

FIG. 11 is a graph illustrating heat-exchange performance of the supercooler according to an embodiment.

Referring to FIG. 11, an X-axis represents a distance from one end to the other end when the second refrigerant flows from the one end of the outer tube 32 of the supercooler 30 to the other end, and a Y-axis represents heat exchange rates of the first and second refrigerants when the second refrigerant flows from the one end of the outer tube 32 of the supercooler 30 to the other end.

Also, a reference symbol L1 represents a line that indicates heat exchange performance of the supercooler 30 in which the baffle 33 is installed according to an embodiment, a reference symbol L2 represents a line that indicates heat exchange performance of the supercooler 30 of the baffle 36 according to another embodiment, and a reference symbol L3 represents a graph that indicates heat exchange performance of the supercooler in which the baffles 33 and 36 are not provided.

As illustrated in FIG. 11, it is seen that, when the baffles 33 and 36 are installed at all positions from one end of the outer tube 32 to the other end, the heat exchange efficiency of the first and second refrigerants are improved.

In the supercooler and the air conditioner including the same according to the embodiments, the supercooling efficiency of the refrigerant condensed in the condenser may be improved.

Also, the noises generated by the flow of the refrigerant within the supercooler and the noises generated by the impact between the inner tube and the outer tube may be reduced.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A supercooler disposed between a condenser and an evaporator of an air conditioner to supercool a refrigerant condensed in the condenser and to thereby allow the supercooled refrigerant to flow into the evaporator, the supercooler comprising:

a plurality of inner tubes in which a first refrigerant comprising the refrigerant condensed in the condenser flows, the plurality of inner tubes being spaced apart from each other;

an outer tube having an inner space in which the inner tube is disposed, wherein the outer tube allows a second refrigerant that is heat-exchanged with the first refrigerant to flow; and a baffle supporting the inner tube to prevent the inner tube from being shaken within the outer tube, the baffle comprising:

a plurality of fixing members that support an outer circumferential surface of the plurality of inner tubes; and a deceleration member that connects adjacent two of the plurality of fixing members to each other, wherein the deceleration member is curved with a curvature radius with respect to a center of the outer tube and extends from an outer circumferential surface of one of the plurality of inner tubes toward an outer circumferential surface of an adjacent one of the plurality of inner tubes.

2. The supercooler according to claim 1, wherein a flow hole in which the second refrigerant flows is defined in the fixing member.

3. The supercooler according to claim 2, wherein the fixing member comprises:

an inner circumferential surface defining the flow hole and surrounding at least a portion of the outer circumferential surfaces of the plurality of inner tubes; and an outer circumferential surface supported by an inner circumferential surface of the outer tube.

4. The supercooler according to claim 3, wherein the inner circumferential surface of the fixing member comprises:

a plurality of seat surfaces on which portions of the outer circumferential surfaces of each of the plurality of inner tubes are respectively seated; and a fixing surface on which the deceleration member is disposed.

5. The supercooler according to claim 4, wherein each of the plurality of seat surfaces of the fixing member has a curved shape to surface-contact the outer circumferential surface of each of the plurality of inner tubes.

6. The supercooler according to claim 3, wherein the deceleration member is disposed between the plurality of inner tubes and installed on the inner circumferential surface of the fixing member.

7. The supercooler according to claim 4, wherein the deceleration member has a first surface disposed on the fixing surface of inner circumferential surface of the fixing member and a second surface that is curved outward from a center of the outer tube.

8. The supercooler according to claim 3, further comprising a plurality of fixing protrusions protruding from the outer circumferential surface of the fixing member and fixed to the inner circumferential surface of the outer tube.

9. The supercooler according to claim 1, wherein the inner tube is provided in plurality, and further comprising:

a branch part coupled to a first end of the outer tube to communicate with the plurality of inner tubes, the branch part branching the first refrigerant into each of the plurality of inner tubes; and a combination part coupled to a second end of the outer tube to communicate with the plurality of inner tubes, the combination part combining the first refrigerant passing through the plurality of inner tubes.

10. The supercooler according to claim 1, wherein the outer tube comprises:

a first hole defined in an outer circumferential surface at the first end of the outer tube to introduce the second refrigerant; and a second hole defined in an outer circumferential surface at the second end of the outer tube to discharge the second refrigerant heat-exchanged with the first refrigerant.

11. The supercooler according to claim 1, further comprising:

a first flow space part defined in the baffle to allow the second refrigerant to flow; and a second flow space part defined between an outer circumferential surface of the baffle and an inner circumferential surface of the outer tube to allow the second refrigerant to flow.

12. An air conditioner comprising:

a compressor to compress a refrigerant;

a condenser to condense the refrigerant compressed by the compressor; and a supercooler to supercool the refrigerant condensed in the condenser, wherein the supercooler comprises:

a plurality of inner tubes in which the refrigerant condensed in the condenser flows, the plurality of inner tubes being spaced apart from each other;

an outer tube with an inner space in which the plurality of inner tubes are disposed, wherein the outer tube allows a second refrigerant that is heat-exchanged with the first refrigerant to flow; and a baffle comprising an outer circumferential surface supported by an inner circumferential surface of the outer tube, and a flow hole in which the second refrigerant flows, wherein the inner circumferential surface of the baffle comprises:

a plurality of first surfaces to respectively support the outer circumferential surface of the plurality of inner tubes; and a second surface to connect adjacent two of the plurality of first surfaces to each other, the second surface including a plurality of second surfaces, wherein the flow hole is defined by the outer circumferential surfaces of the plurality of inner tubes and the plurality of second surfaces.

13. The air conditioner according to claim 12, a baffle further comprises:

a fixing member fixed to each of the plurality of inner tubes to prevent each of the plurality of inner tubes from being shaken, the fixing member including the outer circumferential surface and the plurality of first surfaces of the baffle; and a deceleration member connected to the fixing member to reduce a flow rate of the second refrigerant, the deceleration member including the plurality of second surfaces.

14. The air conditioner according to claim 13, wherein:

the plurality of first surfaces each comprise a seat surface on which the plurality of inner tubes are respectively seated, the fixing member further comprises a fixing surface on which the deceleration member is disposed, and the deceleration member protrudes from the fixing surface towards a center of the flow hole.

15. The air conditioner according to claim 13, wherein the deceleration member is curved with a curvature radius with respect to a center of the outer tube and extends from an outer circumferential surface of one of the plurality of inner tubes toward an outer circumferential surface of an adjacent one of the plurality of inner tubes.

16. The air conditioner according to claim 12, further comprising:

a first flow space part defined in the baffle to allow the second refrigerant to flow; and a second flow space part defined between an outer circumferential surface of the baffle and an inner circumferential surface of the outer tube to allow the second refrigerant to flow.

* * * * *